US006764643B2

(12) United States Patent
Sagawa et al.

(10) Patent No.: US 6,764,643 B2
(45) **Date of Patent: *Jul. 20, 2004**

(54) POWDER COMPACTION METHOD

(76) Inventors: Masato Sagawa, c/o Intermetallics Co., Ltd., 401 Erie, 22-1 Olagecho Matsumuro Nishikyo-ku, Kyoto (JP), 615-8206; Tochihiro Watanabe, c/o Intermetallics Co., Ltd., 401 Erie, 22-1 Olagecho Matsumuro Nishikyo-ku, Kyoto (JP), 615-8206; Hiroshi Nagata, c/o Intermetallics Co., Ltd., 401 Erie, 22-1 Olagecho Matsumuro Nishikyo-ku, Kyoto (JP), 615-8206

( * ) Notice: Subject to any disclaimer, the term of this patent is extended or adjusted under 35 U.S.C. 154(b) by 80 days.

This patent is subject to a terminal disclaimer.

(21) Appl. No.: 10/054,954

(22) Filed: Jan. 25, 2002

(65) Prior Publication Data

US 2002/0098106 A1 Jul. 25, 2002

Related U.S. Application Data

(63) Continuation of application No. 09/474,813, filed on Dec. 29, 1999, now abandoned, which is a continuation-in-part of application No. 09/404,229, filed on Sep. 23, 1999, now abandoned.

(30) Foreign Application Priority Data

Sep. 24, 1998 (JP) ..... H10-269273

(51) Int. Cl.[7] ..... B22F 1/00

(52) U.S. Cl. ..... 419/2; 419/36; 419/37; 419/38

(58) Field of Search ..... 419/38, 2, 36, 419/37

(56) References Cited

U.S. PATENT DOCUMENTS

| | | | | |
|---|---|---|---|---|
| 1,155,652 | A | | 10/1915 | Goeglein |
| 2,042,635 | A | | 6/1936 | Schellens |
| 2,227,308 | A | | 12/1940 | Hildabolt |
| 3,929,476 | A | | 12/1975 | Kirby, Jr. et al. |
| 4,431,449 | A | | 2/1984 | Dillon et al. |
| 4,435,483 | A | * | 3/1984 | Ahslund et al. ..... 419/2 |
| 4,788,254 | A | | 11/1988 | Kawakubo et al. |
| 5,059,387 | A | | 10/1991 | Brasel |
| 5,250,255 | A | | 10/1993 | Sagawa |
| 5,725,816 | A | * | 3/1998 | Sagawa et al. ..... 264/102 |
| 5,855,837 | A | | 1/1999 | Scranton et al. |
| 5,869,548 | A | | 2/1999 | Ikushima et al. |
| 5,930,580 | A | | 7/1999 | Everett |
| 6,051,324 | A | | 4/2000 | Moorhead et al. |
| 6,155,028 | A | * | 12/2000 | Nagata et al. ..... 53/436 |
| 6,475,430 | B1 | * | 11/2002 | Nagata et al. ..... 419/38 |

* cited by examiner

*Primary Examiner*—Daniel J. Jenkins
(74) *Attorney, Agent, or Firm*—Morrison & Foerster LLP

(57) ABSTRACT

A powder compaction method in which a powder p is filled by air tapping or other suitable method into a mold 1, then while the mold 1 being filled with the powder, the powder particles are bound with each other without application of force from outside the mold to form a compact C, and then the compact C is taken out from the mold 1. This method produces a variety of shapes of the compact far greater than in conventional methods, and net shape manufacturing of products with complex shapes is made possible by this method. Because this method uses far less binder compared to MIM and PIM that are expected as methods for producing products with complicated shapes, the time needed for elimination of the binder is much shorter than in MIM and PIM.

27 Claims, 5 Drawing Sheets

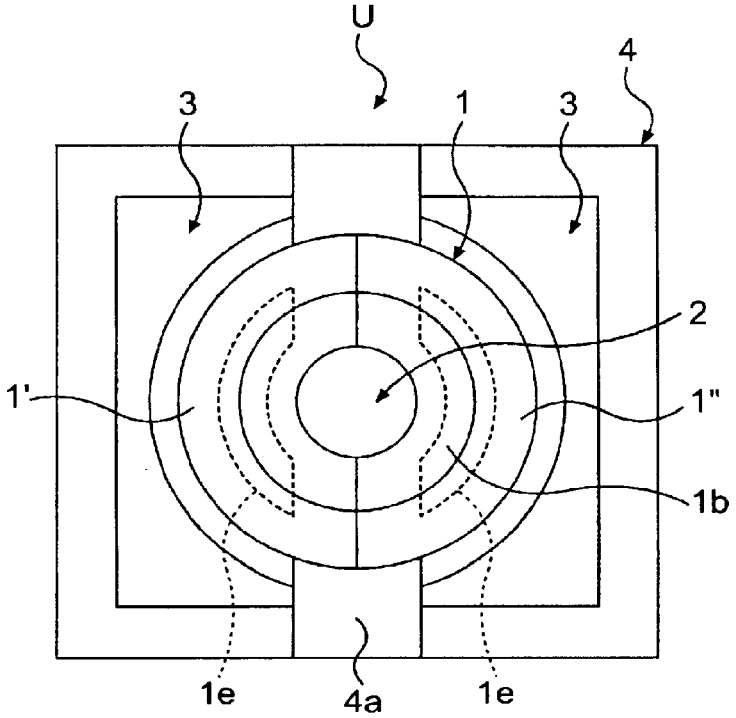
FIG. 3
FIG. 4
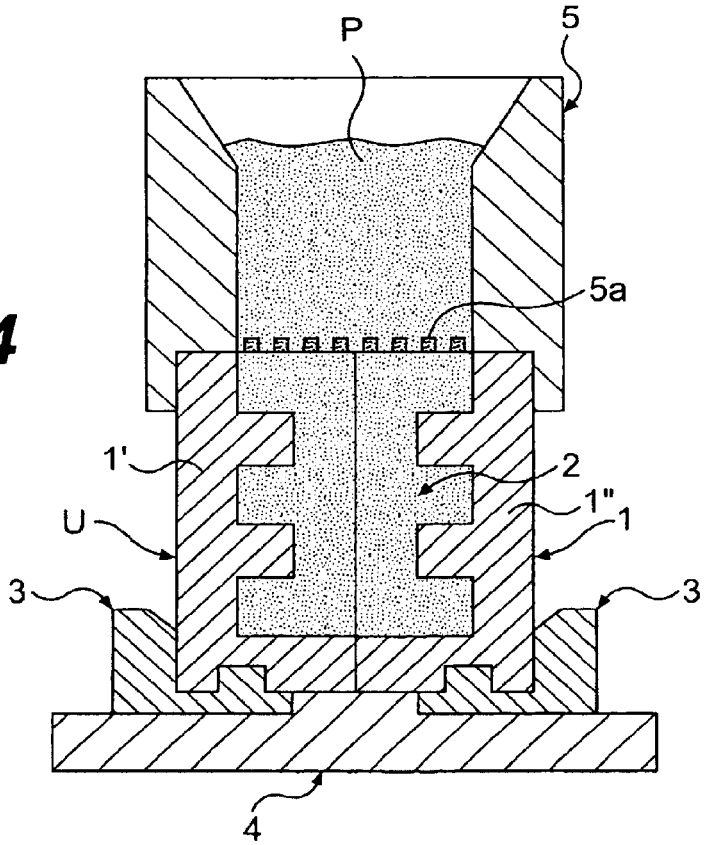

POWDER COMPACTION METHOD

This application is a continuation of Ser. No. 09/474,813, filed Dec. 29, 1999, now abandoned, which is a continuation in part of Ser. No. 09/404,229, filed Sep. 23, 1999, now abandoned.

FIELD OF THE INVENTION

This invention relates to a powder compaction method. The powder compacts obtained by such a method are subjected to a heat treatment or sintering process, by which various kinds of parts such as machine parts are produced.

BACKGROUND OF THE INVENTION

The following methods have been known as powder compaction methods: (1) the die pressing method, in which a powder packed in a cylindrical die is compressed with punches; (2) the cold isostatic pressing (CIP) method, in which a powder packed in a rubber mold is compressed by means of liquid; (3) the rubber isostatic pressing (RIP) method disclosed in U.S. Pat. No. 5,250,255, in which a die is loaded with a rubber mold filled with a powder, and then compressed with punches; (4) the extrusion molding method, in which a slurry of powder is extruded from the die; and (5) the metal injection molding (MIM) or powder injection molding (PIM) method, in which a mixture of a powder and binder is heated until the binder has fluidity, and then injection molded. The metal injection molding together with powder injection molding are hereinafter referred to as "the PIM method".

The die pressing method cannot be applied to compaction of shapes that are impossible to be pulled out of the die, and also pressing long shapes such as tubes is difficult with this method. The CIP method has problems in near-net-shape performance and productivity. The RIP method is advantageous over those two methods above in terms of flexibility of shapes and productivity, in that RIP permits a wider selection of shapes and provides good near-net-shape performance and productivity. However, the RIP method is less flexible than the PIM method in terms of the selection of shapes. The disadvantage of the PIM method is that it uses a mixture of a powder and binder in which the quantity of the binder reaches as much as 40 to 50 volume %. It takes a long time to eliminate such a large amount of binder from the compact in the "debinder process," and this makes it difficult to produce thick and large parts. Carbon contamination during the debinder process is also one of the problems of the PIM method.

SUMMARY OF THE INVENTION

This invention is intended to solve the problems described above that the conventional powder compaction methods suffer, by providing, first, a process in which a mold is filled with a powder by air tapping, while the powder particles are bound with each other without mechanical compaction or the application of force from outside the mold to form a compact, and then the compact is taken out from the mold, second, a process in which a binder is added to the powder so that the powder particles are bound with each other by the binder to form a compact, third, a process in which a lubricant is added to the powder, and fourth, a process in which the powder particles are bound with each other by means of heating.

BRIEF DESCRIPTION OF THE DRAWINGS

FIG. 3 is a top plan view of the mold unit shown in FIG. 2.

FIG. 4 is a vertical sectional view of a mold unit and a feeding hopper used for shaping the compact shown in FIG. 1.

DETAILED DESCRIPTION OF THE INVENTION

Figure 1:
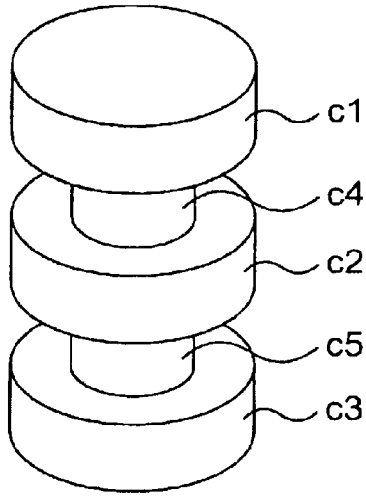
FIG. 1 is a view in perspective of an embodiment of the compact produced by the method of this invention.

In the present invention, a material selected from various kinds of powders such as metal powders, ceramic powders, resin powders and the like which are substantial constituents of the produced by heating or sintering compacts (such powders are hereinafter referred to as "the base powder") or a material comprising a mixture of a base powder and a binder or lubricant is filled into a cavity of a mold, and while the material is being packed in the mold, a treatment such as heat treatment is applied without application of force from outside the mold so that the base powder particles are bound with each other, or the base powder particles are bound with each other without application of force from outside the mold through a binder. Other methods of binding the particles together in the mold include the use of binders that coalesce the particles through a chemical reaction, by partial sintering of the particles in the mold or by means of a thermal diffusion treatment of the powder in the mold. Subsequently, the powder compact in which the base powder particles are bound with each other or the base powder particles are bound with each other through a binder is taken out from the mold. The powder compact is then subjected to a heat treatment or sintering, thereby producing an end product such as a machine part.

As described above, in this invention, a powder is filled into a mold by air tapping, and then subjected to a treatment such as heat treatment without application of force from outside the mold so that the base powder particles are bound to each other or the base powder particles are bound to each other through a binder, thereby producing a powder compact.

The air tapping method disclosed in U.S. Pat. No. 5,725,816 is a powder filling method invented by the present inventors in which a powder is filled into a cavity or container in a short time, with a homogeneous and high density. The disclosure of U.S. Pat. No. 5,725,816 is incorporated by reference fully into this specification. As disclosed in U.S. Pat. No. 5,725,816, the air tapping method is defined as a packing method comprising the steps of supplying a material into a space comprising a space part to be packed with the material and a space connecting with the space part, and subjecting the space supplied with the material to an air tapping process at least once in which the air-pressure inside the space is switched from a low air-pressure state to a high air-pressure state alternately, thereby packing the material into the space part at a high packing-density. In a typical form of this filling method, a powder feeding hopper loaded with a powder is mounted upon the opening of a cavity, then first the air existing in the hopper and cavity is evacuated, and then from the opening of the cavity, air is introduced into the cavity through the feeding hopper. The switching of air-evacuation to air-introduction is carried out rapidly by operation of a high speed valve, and this switching is repeated several times. The speed of the air flow is high when the air flows from the feeding hopper toward the bottom of the cavity, and low when the air flows reversibly. The powder in the hopper is thus filled into the cavity with a high density. Because this process is carried out with a sound resembling a mechanical tapping while the powder is highly densified, it is called "air tapping". The air tapping method can also be used for filling a cavity with two openings. In this case, the feeding hopper is mounted upon one of the two openings, and from another opening, air in the feeding hopper and the cavity is evacuated. Then the opening through which air is evacuated is closed, and air is introduced rapidly from the top opening of the feeding hopper into the cavity. This cycle comprising the air-evacuation followed by the air-introduction is repeated several times so that the powder is filled into the cavity with a high density.

In the form of air tapping explained above for use in the present invention, the air in the spaces of the hopper and the cavity that is at one atmosphere of pressure is first evacuated. This means that the low air-pressure state is lower than one atmosphere. In another form of this filling method, the low air-pressure state is kept at one atmosphere, and the high-air pressure state is raised to a pressure higher than one atmosphere. In such a case, the air-introduction is carried out against the existing air-pressure that is at one atmosphere at the beginning.

By means of this air tapping method, powders can be filled into a cavity in a short time, homogeneously and to a high density. In addition, cavities with complex shapes such as a cavity consisting of several projecting parts can be thoroughly filled with powder homogeneously and to a high density in all comers of the mold cavities.

The present inventors determined that the above advantages of the air tapping method could be utilized by adapting the RIP method. After a powder is compressed by RIP and while the pressure was decreased for taking out the compact from the cavity, the cavity is restored to its original shape. However, during this restoration, we found that the compact sometimes suffered from many cracks. Due to this defect, the range of compressible shapes of the compact was limited.

The present inventors then determined that the powder particles filled into a cavity by the air tapping method could be bound to each other by means other than pressing, and verified the effectiveness of this method through repeated experiments. This invention makes it possible to obtain powder compacts with complex shapes with a minimum use of binders, of which PIM needs to use much more.

The obtained powder compacts were then subjected to a heat treatment, thereby producing parts with complex shapes with high performance and high productivity.

We also found that an important technique for filling a powder homogeneously and in a highly densified state into a cavity having many projecting parts includes the addition of a lubricant to the powder, so that the lubricated powder is smoothly transferred deep into the cavity by the air flow. If the lubrication of the powder is insufficient, the powder tends to stick in the division corners of the mold, which may affect the performance of the present invention. Except for powders such as Teflon powder having lubrication themselves, lubricants or surfactants such as zinc stearate should be added to the powder and stirred and mixed enough so that the surfaces of the powder particles are covered with the lubricant. By using such well-lubricated powders, even such cavities with complex shapes having many projecting parts can be filled with powder homogeneously and to a highly densified state. The powder particles are then bound to each other and subjected to a heat treatment or sintering, thereby producing machine parts or the likes with high performance.

As the lubricant, any kind of surfactant such as metallic soaps, waxes, greases can be used. However, in order to efficiently fill the powder into the cavity by air tapping, the kind and quantity of the lubricant should be determined so that the powder does not agglomerate or have cohesiveness. The added lubricant is to be eliminated together with the binder during the debinder process. Therefore, preferably, solid lubricants such as metallic soaps, e.g., zinc stearate, calcium stearate, barium stearate, aluminum stearate, magnesium stearate and other such metallic soaps, rather than liquid lubricants such as greases should be used as the lubricant. The preferable quantity of the lubricant is 0.5–14 volume percent (vol %), and preferably, 1–10 vol %.

The mixing of the binder can be carried out in either way of the following:

(1) A powder with a fusing point lower than that of the base powder (hereinafter this powder is referred to as "the binder powder") is mixed with the base powder, and the mixture is filled into a mold. Once the mixture is filled into the mold, a heat treatment is applied to the mixture so that only the binder powder is fused. The base powder particles are bound with each other through the fused binder powder. Then the mold is cooled and the powder compact is taken out.

(2) The particle surfaces of the base powder are coated with the binder. The binder-coated base powder is filled into a mold. Subsequently, the filled base powder is subjected to an appropriate treatment (such as a chemical treatment, light or thermal diffusion) so that the base powder particles are bound with each other through said binder, and then the powder compact is taken out.

The material for the binder should have a fusing point lower than that of the base powder. Resins are low fusing point good materials for the binder, and both thermosetting resins and thermoplastic resins can be used. However, in order to obtain sufficient bonding force with minimum use of the binder, thermoplastic resins are more preferable. Furthermore, as described later, when employing a means other than heat treatments, instantaneous adhesives such as cyanoacrylate, ultraviolet hardening resins and resins which become adhesive by addition of water such as PVAs can be used being mixed with the base powder, or as the material for coating the surfaces of base powder particles.

In the present invention, the binder should only have sufficient bonding force to bind the base powder particles to each other. Therefore, the quantity of the binder to be blended does not need to be so high as the 40–50 vol % that is needed in the PIM method, but as low as 4–20 vol % is enough for the present invention. Even when a lubricant is mixed, the total ratio of the binder and lubricant may be as low as 5–30 vol %, and most of the time it is adjustable to the range from 5 to 20 vol %. Because of the far smaller quantity of binder than that used in PIM, it takes only several hours to eliminate the binder in the present invention, while the debinder process in PIM takes a few days. PIM cannot be adopted for producing thick or large parts due to the large quantity of the binder, which is as much as 40–50 vol %. When producing thick and large parts by PIM, it takes a long time to eliminate the binder, the elimination tends to be insufficient, or compacts break due to swelling during the debinder process. Because of the use of far less binder, the present invention allows such thick and large parts to be produced without problems.

In the PIM method, compacts are produced from a mixture of a powder and binder which is fused and subjected to pressure in an injection molding device. Therefore, the die needs to be made of a metal with a high strength, causing the die costs to swell. In addition, because the compacts are produced by means of injection molding in PIM, the flowability of the powder to be fused needs to be increased by adding a binder as much as 40–50 vol %. In PIM, the large quantity of the binder should be eliminated before sintering. If the debinder process is carried out promptly at a high temperature in this method, the compacts tend to deform or break. To prevent such problems, it takes a few days or more to get through the debinder process, which causes poor productivity in the PIM method. In the present invention, the powder is directly filled into a mold, and the quantity of the binder to be added is far less than that in PIM. The time for the debinder process in the present invention can therefore be as short as that in ordinary powder compaction methods. In addition, because of the good flowability of the powder, even cavities with complex shapes can be filled by air tapping as well as by using a mold with a separated body. Because the present invention can employ not only molds made of metals but also molds made from materials which are easy to shape such as synthetic resins, production of the molds is easy and cheap which leads to largely reduced production costs.

Examples of the present invention are hereinafter explained in which a mixture of a binder powder and a base powder is filled into a mold to produce a compact C shown in FIG. 1 consisting of three discs c1, c2 and c3 which are connected by two cylinders c4 and c5.

Figure 2:
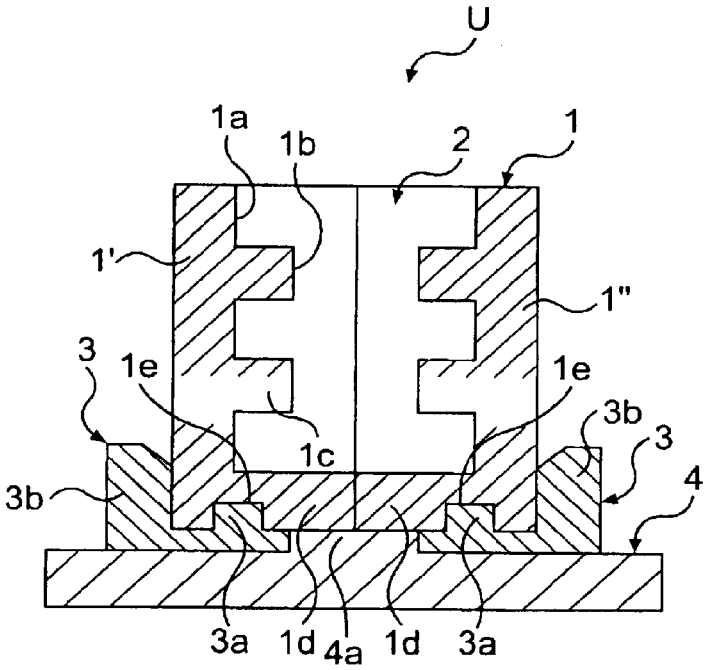
FIG. 2 is a vertical sectional view of a mold unit used for molding the compact shown in FIG. 1.
Figure 5:
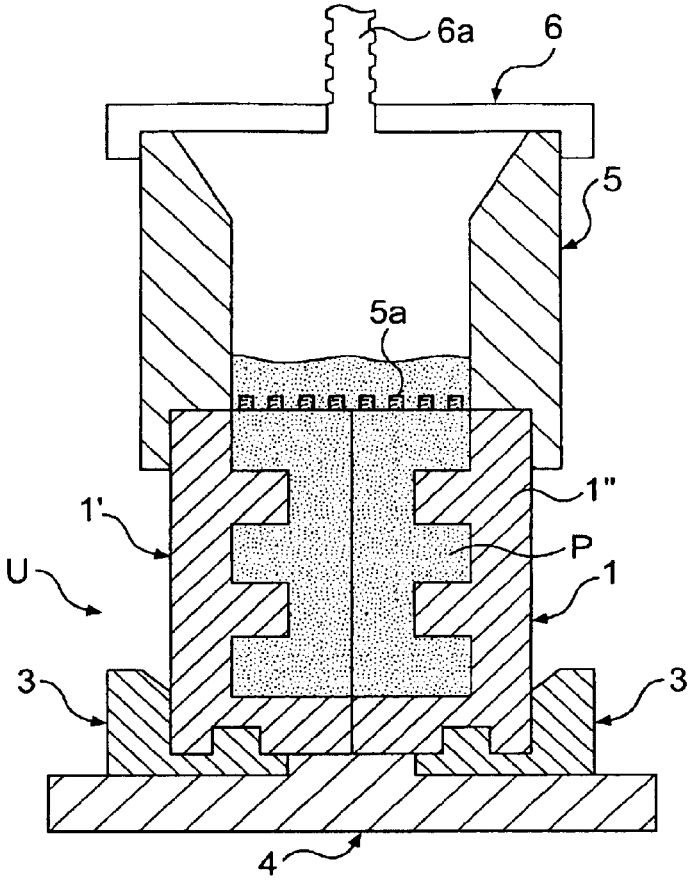
FIG. 5 is a vertical sectional view of a mold unit and feeding hopper with a cover element used for shaping the compact shown in FIG. 1.
Figure 6:
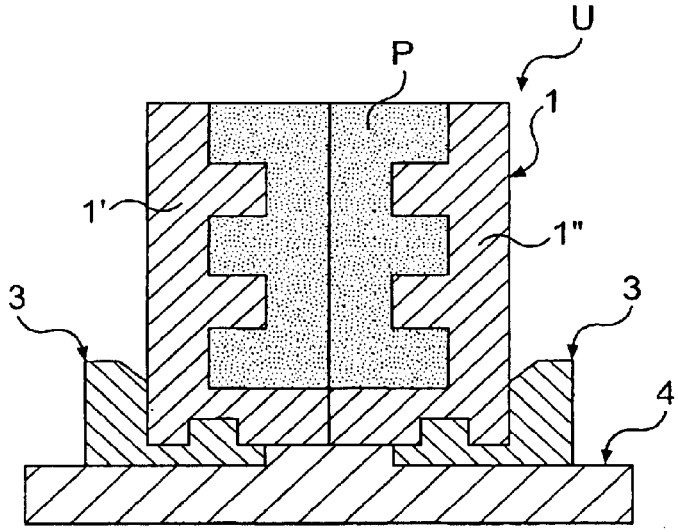
FIG. 6 is a vertical sectional view of a mold unit filled with a powder.

As shown in FIGS. 2 and 3, a mold made of a hard synthetic resin, metal or hard rubber is denoted by 1. The mold 1 is provided with a cavity 2 for shaping the compact 1 in FIG. 1. The mold 1 has an open top and projecting ring parts 1*b* and 1*c* to form the cylindrical parts of the compact C, c4 and c5, respectively. In order to take out the formed compact C from the mold 1, the mold 1 is separated along the center into two parts 1' and 1". The bottom 1*d* of parts 1'and 1"is provided with recesses 1*e* which are formed as arcs having a radius smaller than that of outer periphery of the mold 1.

Movable blocks 3 on which the separated mold parts 1' and 1" are mounted are located at the bottom of the mold 1 properly spaced from each other. The movable blocks 3 are provided with projecting parts 3*a* which are to be inserted into the recesses 1*e* formed in the bottom 1*d*, as well as with projecting parts 3*b* which have surfaces contacting with an outer peripheral wall of the separated mold parts 1' and 1".

A table element 4 is provided with a projection 4*a* to be inserted into the space between the movable blocks 3, and a part of the bottoms 1*d* of the separated mold parts 1' and 1" is mounted upon the projection 4*a*. The movable blocks 3 are mounted on the table element 4. The mold unit U comprises the mold 1 consisting of separated mold parts 1' and 1", the pair of movable blocks 3, and the table element 4.

Now the process of producing the compact C by using the mold unit U mentioned above is described.

As shown in FIG. 4, a cylindrical hopper 5 is mounted on the top surface of the mold 1. A grid element 5*a* is attached to the bottom opening of the hopper 5. The grid element 5*a* may comprise wires formed in parallel by a certain distance, or meshes of a certain size or a thin metal plate punched to have a number of holes of uniform size. The grid size (or distance between wires, mesh size, or size of punched holes) is adjusted so that the powder mixture (hereinafter simply referred to as the "powder") can pass through the grid element 5*a* during air tapping, but cannot substantially pass through when the powder is fed into the hopper 5 from a powder feeder not shown in the drawing.

The hopper 5 is mounted on the top surface of the mold 1 of the mold unit U. The hopper 5 is loaded with a powder p fed from a powder feeder not shown in the figure. The quantity of the powder p is naturally larger than that to be filled into the cavity 2, but preferably it should be enough that after the powder p is filled into the cavity 2 of the mold 1 by air tapping, there is still quite a bit of powder p remaining in the hopper 5. It is also possible to mount the hopper 5 preliminarily loaded with the powder p on the top surface of the mold 1.

Subsequently, a cover element 6 provided with an air evacuation/introduction pipe 6*a* is mounted onto the top opening of the hopper 5 mounted on the top surface of the mold 1. Then by means of a low and high-air pressure generator not shown in the figure, the air inside the hopper 5 is evacuated through the air evacuation/introduction pipe 6*a* so that the inside of the hopper 5 is brought into a low-air-pressure state. Subsequently, by the low and high-air pressure generator, air is introduced rapidly into the hopper 5 through the air evacuation/introduction pipe, so that the inside of the hopper 5 is brought into a high-air-pressure state. This cycle is repeated several times. Through this air tapping process, the powder p loaded in the hopper 5 is filled into the cavity 2 of the mold I through the grid element 5*a*. After the cavity 2 of the mold 1 is filled with the powder p, the cover element 6 is detached from the top opening of the hopper 5 which is then dismounted from the mold 1 filled with the powder p, when the powder p is divided into a portion filling the cavity 2 of the mold 1, and a portion remaining in the hopper 5.

In this example, the low-air pressure state is lower than one atmosphere of pressure. However, as previously stated, air tapping may be carried out in a pressure over one atmosphere when the low air-pressure state is at one atmosphere and the high air-pressure state is higher than one atmosphere.

Subsequently, the mold unit U filled with the powder p is put in heat treatment equipment such as a furnace so that the powder p is subjected to a heat treatment. The heat treatment temperature should be too low to fuse the base powder but high enough to fuse the binder powder. By such a heat treatment, liquid us resin resulting from the fusing of the binder powder thoroughly fills the spaces between the base powder particles. After heat treatment for an appropriate time, the mold unit U is taken out from the heat treatment equipment, and then cooled. The mold unit U may be cooled naturally in a room temperature, or compulsory by applying a cooled air.

Figure 7:
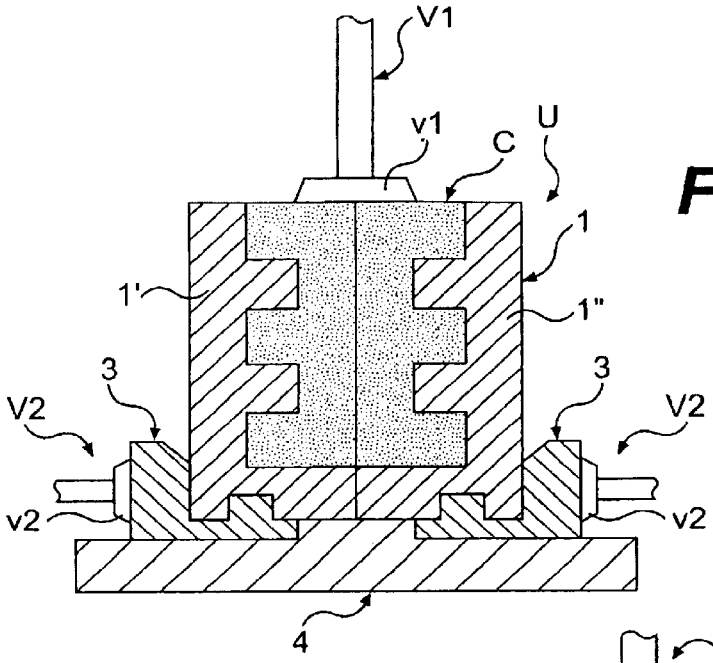
FIG. 7 is a vertical sectional view of a mold unit illustrating a step for ejecting the compact.

As shown in FIG. 7, the powder compact C is then held with a suction pad v1 which is attached to a vertically movable vacuum suction device V1 placed on the compact C in the mold 1 driven by a cylinder or the like although not shown. Before or after the compact C is sucked by the vacuum suction device V1, suction pads v2 are attached to the outer peripheral walls of the movable blocks 3, and by means of a vacuum suction device V2 which is driven by a cylinder or the like not shown, the movable blocks 3 are sucked with the suction pad v2.

Figure 8:
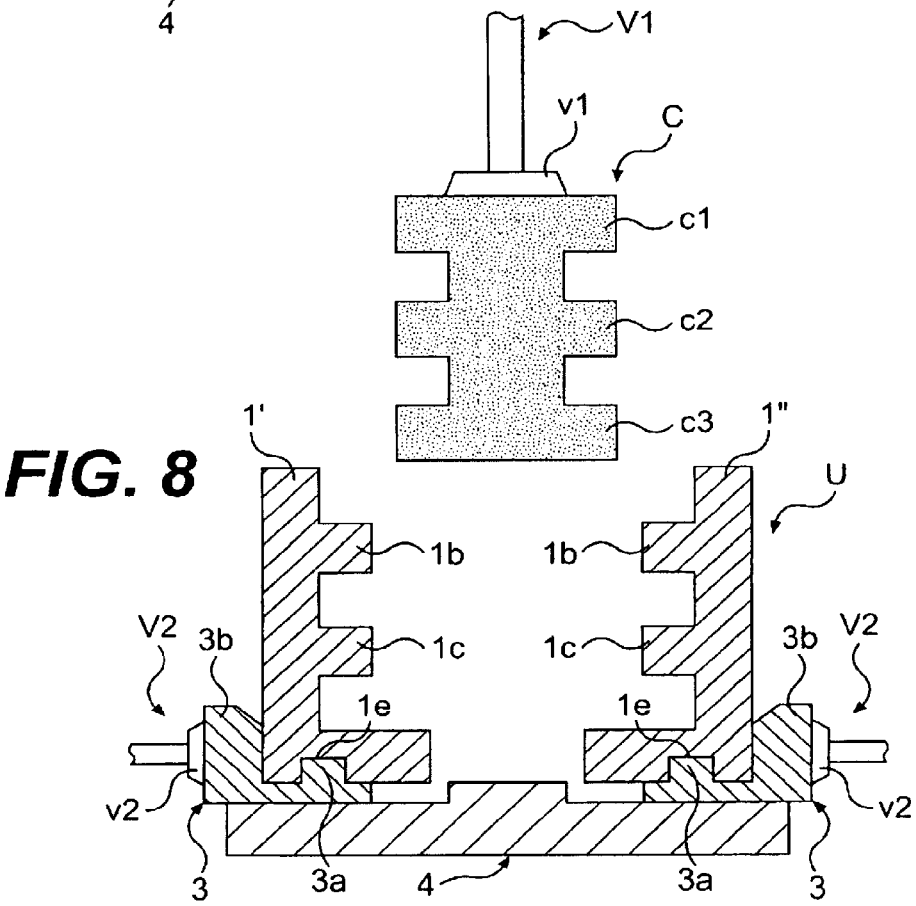
FIG. 8 is a vertical sectional view of a mold unit illustrating the ejection step following the step in FIG. 7.

Subsequently, by driving the vacuum suction device V2, movable blocks 3 attached to the suction pad v2 are moved horizontally on the table element 4 away from each other, by which the separated mold parts 1' and 1" which are inserted in the recesses 1*e* provided in the bottoms 1*d* are also moved horizontally away from each other. After the ring parts 1*b* and 1*c* are pulled out of the clearances formed between the disc parts c1~c3 of the compact C, the driving of the vacuum suction device V2 is stopped so as to stop the movement of the movable blocks 3. Then, the driving of the vacuum suction device V1 is stopped, and the compact C sucked and attached to the suction pad v1 is taken out from the mold 1 by moving the compact C upward, or forward or backward relative to the plane of FIG. 8.

The compact C taken out by means of the vacuum suction device is then transferred to the debinder process to remove the binder resin, i.e., fused binder powder. After the binder is eliminated, the desired end product such as a machine part is obtained.

Meanwhile, the vacuum suction device V2 is driven again and the movable blocks 3 sucked and held with the suction pads v2 are moved reducing the distance between them so that the separated mold parts 1' and 1" are brought into contact. Then, by stopping the work of the vacuum suction device, the movable blocks 3 are released from the suction pads v2, and the vacuum suction device V2 is moved by its driving mechanism so as to come to the standby position away from the mold unit U.

Figure 9:
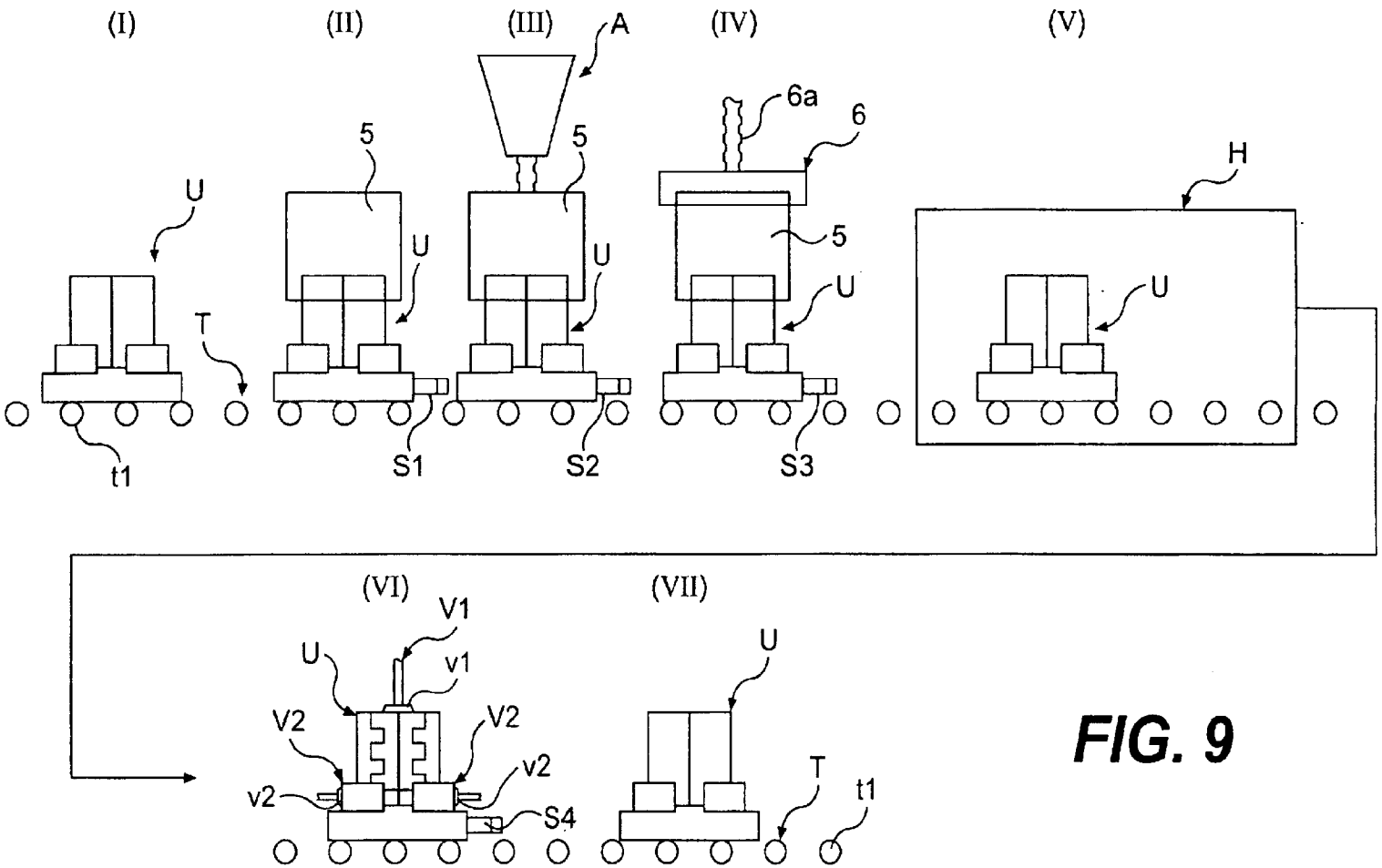
FIG. 9 is a schematic view of the powder compaction process of this invention.

FIG. 9 illustrates an example of the continuous production system of powder compacts comprising the powder filling process in which the powder p is filled into the cavity 2 of the mold 1 through the hopper 5, the air tapping process, the heat treatment process to which the mold unit U comprising the mold 1 filled with the powder p is subjected, and the ejecting process in which the powder compact is taken out from the mold 1 of the mold unit U.

The mold unit U containing mold 1 of which cavity is not filled with powder p is placed on conveyer equipment T which comprises a conveyer belt or roller conveyer constantly or intermittently moving by which the mold unit U is transferred to the right direction in FIG. 9 (Step I). In the example of FIG. 9, a roller conveyer t1 is shown as the conveyer equipment T which is driven by a driving mechanism not shown in the figure.

Subsequently, a stopper S1 is forwarded into the transfer line of the mold unit U being transferred to the right by the roller conveyer t1 so that the mold unit U is stopped upon contacting the stopper S1. With the mold unit U being stopped, by an automated machine such as a robot, the hopper 5 is mounted on the mold 1 of the mold unit U (Step II).

The stopper S1 is then withdrawn from the transfer line of the mold unit U and the mold unit U is again carried by the conveyer equipment T. After that, a stopper S2 is forwarded into the transfer line of the mold unit U so as to stop the mold unit U at the position provided with the powder feeder A by which the powder is poured into the hopper 5 (Step III).

Subsequently, the stopper S2 is withdrawn from the transfer line of the mold unit U, and the mold unit U on which the hopper 5 is mounted is transferred to the position of the air tapping process, when the stopper S3 is forwarded to stop the mold unit U (Step IV).

Then, the top opening of the hopper 5 is covered with a cover element 6 provided with the air evacuation/introduction pipe 6*a*, and air tapping is carried out to fill the powder p in the hopper 5 into the cavity 2 of the mold 1 through the grid element 5*a*. After the cavity 2 is filled with the powder p, the cover element 6 and hopper 5 are dismounted. Or, the hopper 5 may be dismounted at the next stage.

The stopper S3 is then withdrawn from the transfer line of the mold unit U, the mold unit U with the cavity 2 of the mold 1 filled with powder p is carried into heat treatment equipment H formed as a tunnel (Step V), where the binder powder is fused to be a liquidus resin that thoroughly fills the spaces between the base powder particles.

The mold unit U after exiting the heat treatment equipment H is naturally or force-cooled. Then a stopper S4 is forwarded to contact the mold unit U. When the mold unit U stops, the suction pad v1 of the vacuum suction device V is attached to the top surface of the compact C in the mold 1, and the suction pads v2 of the vacuum suction device V2 are attached to the movable blocks 3 as well (Step VI).

Then by driving the vacuum suction device V2, the separated mold parts 1' and 1" are moved away from each other, and the ring parts of the mold 1, 1*b* and 1*c* are ejected from the clearances between the disc parts c1~c3. The driving mechanism of the vacuum suction device V2 is then stopped to stop the transferring of the movable blocks 3, when the vacuum suction device V1 is driven to suck and hold the compact C with the suction pad v1 and the compact C is taken out from the mold 1.

By working the driving mechanism for the vacuum suction device V2, the movable blocks 3 sucked and held with the suction pad v2 of the vacuum suction device V2 are moved close to each other so that the separated mold parts 1' and 1" are brought into contact. Then the vacuum suction device V2 is stopped so as to release the movable blocks 3 from the suction pad v2, and the vacuum suction device V2 is driven by the driving mechanism to move away from the mold unit U to its standby position (Step VII). The mold unit U from which the compact C is ejected now comprising the separated mold parts 1' and 1" in contact with each other is brought back to Step I in FIG. 9, while the ejected compact C is transferred to the debinder process so that the binder resin contained in the compact C is eliminated. After this debinder process, the desired end products such as machine parts are obtained. In the above described example, the mold 1 comprises two separated mold parts 1' and 1" and is held by a pair of movable blocks 3 and a table element 4. However, in another embodiment, the mold 1 may be held by a table provided with recesses into which the lower part of the mold 1 can be inserted. It is also possible to construct the mold unit by binding the separated mold parts 1' and 1" with a band or some other structure to prevent them from separating. In the case of using a mold 1 comprising one body, it is of course unnecessary to install such a holding means.

The dimensions of the compact C which is shown in FIG. 1 and produced in the above example were as follows: The disk parts c1~c3 were 40 mm in diameter and 10 mm in thickness, and the cylinder parts c4 and c5 are 20 mm in diameter and 10 mm in length. The base powder used was a ferrite powder with average particle size of 50 $\mu$m and 90 vol % in quantity. The powder used as a binder powder was an epoxy resin powder with a fusing point of 65° C. and 8 vol % in quantity. As the lubricant, 2 vol % magnesium stearate was added. The ferrite powder, epoxy resin powder and magnesium stearate were well mixed in a rocking mixer.

The compact C in FIG. 1 was produced using the above powder mixture by the above described compaction method. The compacts taken out from the separated mold parts 1' and 1" had no cracks nor chipping, as well as they were strong enough to endure any handling in the transfer line and debinder process or in other processes. The time consumed for elimination of the binder was about two hours, which was far less than the debinder time needed in MIM and PIM.

In the example explained above, a powder mixture containing at least a base powder and a binder powder was used. In another case, it is also possible to apply a resin coating to the base powder, and to fill the resin-coated base powder into a mold which is then subjected to a heat treatment so that the resin is fused to bind the powder particles with each other. In this case, thermoplastic resins are preferred to thermosetting rezins.

As a means for the heat treatment, high-frequency heating may be employed instead of the furnace in the above example. As the high-frequency heating means, a high-frequency induction heating unit utilizing the heat generation of a magnetic material effected by the hysteresis loss and the Joule effect of eddy currents in a high-frequency magnetic field of 300K~3 Mz, and a high-frequency induction heating or microwave heating used in microwave ovens utilizing the heat generation of a dielectric due to the dielectric loss in a high frequency of 3~30 MHz can be used.

In the example above, a mixture containing at least a base powder and a binder powder is filled into a cavity of a mold, and then the powder filled mold is subjected to a heat treatment at a temperature high enough to fuse the binder powder but too low to fuse the base powder, thereby fusing the binder powder so that the base powder particles are bound with each other through the fused binder powder. This process may be carried out as described below so that the obtained compact does not suffer cracks or chipping, thus retaining its shape for easy handling.

A base powder containing no water is coated with an instant adhesive which works as a binder and hardens by absorbing humidity, and the coated base powder is filled into a mold in an atmosphere with very low humidity. Subsequently, a gas containing water (air or $N_2$ gas) is introduced into the base powder in a mold so that the instant adhesive coating the base powder is hardened, thereby binding the base powder particles with each other so as to retain the shape of the obtained compact.

In another case, an adhesive which hardens when receiving ultraviolet rays may be used as a binder. The base powder is coated with such an adhesive, and the coated base powder is filled into a mold made of a transparent material through which ultraviolet rays can pass. Then ultraviolet rays are applied to the mold filled with said base powder so that the adhesive is hardened and binds the base powder particles with each other, thereby retaining the shape of the obtained compact.

Or, a material such as PVA (polyvinyl alcohol) that exerts its bonding force when containing water can also be used as the binder. Such a material in the form of powder is mixed with the base powder. The mixture of the base powder and said material that is to have bonding force when containing water is kept dry and filled into a mold. Subsequently, water is blown into the powder mixture so that the binder material gets to have a bonding force by which the base powder particles are bound with each other.

The process may also be carried out without using binders but only a base powder. After the base powder is filled into a mold, it is subjected to a heat treatment to a degree by which the base powder is slightly sintered or deposited so that the base powder particles are bound with each other, thereby producing a powder compact. However, if the base powder filled into a mold is heated to a too high temperature, the powder that is excessively sintered or fused causes the compact to break, and the desired product cannot be obtained.

When constructed as described above, the present invention has the following advantageous effects. The variety of shapes of the compact is far wider in this invention than in other conventional methods, and net shape manufacturing of products with complex shapes is made possible by this invention. Because the present invention uses far less binder compared to MIM and PIM that are expected as methods for producing products with complicated shapes, the time needed for debinder is much shorter than in MIM and PIM, which require too long time for elimination of the binder. The productivity is therefore improved in the present invention. The present invention has made it possible to produce large products or thick products with complex shapes that have been difficult to produce by MIM and PIM due to the difficulty of elimination of the large quantity of binders.

We claim:

1. A powder compaction method, comprising:

filling a powder into a mold by air tapping, binding the particles of said powder to each other without application of force from outside the mold after the mold is filled with said powder to form a powder compact, and then removing the powder compact from said mold.

2. A powder compaction method according to claim 1, further comprising adding a binder to the powder to be filled.

3. A powder compaction method according to claim 1 or 2, further comprising adding a lubricant to the powder to be filled.

4. A powder compaction method according to claim 1 or 2, in which the binding of the powder particles is carried out by a heat treatment within the mold.

5. A powder compaction method according to claim 3, in which the binding of the powder particles is carried out by a heat treatment within the mold.

6. A powder compaction method according to claim 2, in which the binding of the powder particles is carried out by a chemical reaction within the mold.

7. A powder compaction method according to claim 3, in which the binding of the powder particles is carried out by a chemical reaction within the mold.

8. A powder compaction method according to claim 2, in which the binder is present in an amount of 4 to 20 volume % of the powder particles.

9. A powder compaction method according to claim 3, in which the lubricant is present in an amount of 0.5 to 14 volume % of the total powder particles, binder and lubricant.

10. A powder compaction method according to claim 3, in which the lubricant is present in an amount of 1 to 10 volume % of the total powder particles, binder and lubricant.

11. A powder compaction method according to claim 10, in which the binder and lubricant are present in an amount of 5 to 30 volume % of the total powder particles, binder and lubricant.

12. A powder compaction method according to claim 3, in which the binder and lubricant are present in an amount of 5 to 20 volume % of the total powder particles, binder and lubricant.

13. A powder compaction method according to claim 2, wherein the binder is selected from the group consisting of thermoplastic resins, thermosetting resins, cyanoacrylate resins, polyvinyl alcohol, ultraviolet hardening resins and resins which become adhesive by the addition of water.

14. A powder compaction method according to claim 3, wherein the lubricant is a metallic soap.

15. A powder compaction method, comprising:

transferring an empty mold to a first position;

mounting a hopper onto the empty mold at the first position;

transferring the mold equipped with the hopper to a second position at which a powder is filled into the hopper, transferring the mold equipped with the hopper filled with the powder to a third position;

filling the powder into the mold at the third position by air tapping;

transferring the mold filled with powder to a heat treatment apparatus;

binding the particles of said powder to each other without application of force from outside the mold by a heat treatment in said heat treatment apparatus and allowing the mold to cool to form a powder compact within the mold, transferring the mold to a fourth position and attaching a suction device to the powder compact within the mold; and removing the powder compact from said mold with said suction device.

16. The powder compaction method of claim 15, wherein said heat treatment apparatus is a high-frequency induction heater or a microwave heater.

17. A powder compaction method for producing a green compact as an intermediate for making a sintered final product, comprising:

filling a mixture of a powder and a binder into a mold by air tapping, binding the particles of said powder to each other without application of force from outside the mold after the mold is filled with said powder to form a powder compact, driving the binder off from said powder compact to form said green compact, and then removing the green compact from said mold.

18. A powder compaction method according to claim 17, in which the binding of the powder particles is carried out by heat treatment within the mold.

19. A powder compaction method according to claim 17, in which the binding of the powder particles is carried out by a chemical reaction within the mold.

20. A powder compaction method according to claim 17, in which the binder is present in an amount of 4 to 20 volume % of the powder particles.

21. A powder compaction method according to claim 17, in which the mixture further comprises a lubricant present in an amount of 0.5 to 14 volume % of the total powder particles, binder and lubricant.

22. A powder compaction method according to claim 21, in which the lubricant is present in an amount of 1 to 10 volume % of the total powder particles, binder and lubricant.

23. A powder compaction method according to claim 22, in which the binder and lubricant are present in an amount of 5 to 30 volume % of the total powder particles, binder and lubricant.

24. A powder compaction method according to claim 22, in which the binder and lubricant are present in an amount of 5 to 20 volume % of the total powder particles, binder and lubricant.

25. A powder compaction method according to claim 17, wherein the binder is selected from the group consisting of thermoplastic resins, thermosetting resins, cyanoacrylate resins, polyvinyl alcohol, ultraviolet hardening resins which become adhesive by the addition of water.

26. A powder compaction method for producing a green compact as an intermediate for making a sintered final product, comprising:

transferring an empty mold to a first position;

mounting a hopper onto the empty mold at the first position;

transferring the mold equipped with the hopper to a second position at which a mixture of a powder and a binder is filled into the hopper;

transferring the mold equipped with the hopper filled with the mixture to a third position;

filling the mixture into the mold at the third position by air tapping;

transferring the mold filled with the mixture to a heat treatment apparatus;

binding the particles of said powder to each other without application of force from outside the mold by a heat treatment in said heat treatment in said heat treatment apparatus and allowing the mold to cool to form a powder compact within the mold, driving the binder off from said powder compact to form said green compact, transferring the mold to a fourth position and attaching a suction device to said green compact within the mold; and removing said green compact from said mold with said suction device.

27. The powder compaction method of claim 26, wherein said heat treatment apparatus is a high-frequency induction heater or a microwave heater.

* * * * *